United States Patent [19]

Grasseschi

[11] Patent Number: 4,706,759

[45] Date of Patent: Nov. 17, 1987

[54] SPRINKLER ASSEMBLY

[76] Inventor: John J. Grasseschi, 1299 Grafton St., Worcester, Mass. 01604

[21] Appl. No.: 884,358

[22] Filed: Jul. 11, 1986

[51] Int. Cl.[4] ..... A62C 25/00; A62C 37/08; E04B 1/00

[52] U.S. Cl. ..... 169/51; 169/42; 52/98

[58] Field of Search ..... 169/37–42, 169/51, 52, 56, 90; 52/98

[56] References Cited

U.S. PATENT DOCUMENTS

| | | | |
|---|---|---|---|
| 2,389,331 | 11/1945 | Tyden | 169/37 |
| 2,558,450 | 6/1951 | Martin | 169/37 |
| 2,890,758 | 6/1959 | Pfalzgraff | 169/37 |
| 3,198,258 | 8/1965 | Werner | 169/37 |
| 3,393,746 | 7/1968 | Hodnett | 169/41 |
| 3,998,273 | 12/1976 | Juliano | 169/37 |
| 4,014,388 | 3/1977 | Anderson | 169/37 |
| 4,066,129 | 1/1978 | Anderson | 169/37 |
| 4,215,751 | 8/1980 | Mears | 169/51 |
| 4,596,289 | 6/1986 | Johnson | 169/37 |

*Primary Examiner*—Andres Kashnikow
*Assistant Examiner*—Patrick N. Burkhart
*Attorney, Agent, or Firm*—Blodgett & Blodgett

[57] ABSTRACT

Recessed sprinkler apparatus including a cover plate having a melting temperature substantially lower than the release temperature of the sprinkler head.

6 Claims, 2 Drawing Figures

SPRINKLER ASSEMBLY

BACKGROUND OF THE INVENTION

In the design and construction of sprinkler systems, it is common practice to mount the individual sprinkler head in a so-called "recessed" mode. In this construction, the sprinkler head is located above an aperture in the ceiling and does not extend below the ceiling; a cover plate is provided which is usually arranged to fall away from the ceiling and from the sprinkler head at a given temperature in order to expose the sprinkler to the hot gases from a fire. In the past, these cover plates have been mounted for the support of the cover plate on a tubular extension which, after the sprinkler is installed, is attached to a similar tubular portion surrounding the sprinkler. Since the location of the sprinkler can vary by considerable amounts, due to the water distribution pipe locations above the ceiling, it has always been difficult to place the cover in position properly, so that it is not spaced from the surface of the ceiling. Furthermore, a bayonet lock was used to join the two tubular parts and this made it difficult for the installer to make a good connection. Also, such equipment is quite expensive, since all the parts are made of stamped metal and held together by a low-temperature alloy. These and other difficulties experienced with the prior art devices have been obviated in a novel manner by the present invention.

It is, therefore, an outstanding object of the invention to provide a sprinkler assembly in which a recessed sprinkler head has an improved appearance.

Another object of this invention is the provision of a sprinkler assembly including a casing and cover plate which are easy to apply by the sprinkler installer.

A further object of the present invention is the provision of a sprinkler assembly including a cover plate which drops away at a substantially low temperature to expose the sprinkler head.

It is another object of the instant invention to provide a sprinkler asembly which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a sprinkler assembly having a water distribution pipe to which is connected a sprinkler head which is operative when exposed to a preselected temperature. A ceiling underlies the sprinkler piping and has a lower surface that is below the lowest point of the sprinkler heas; the ceiling has an aperture in which the lowest point of the sprinkler head lies. A tubular casing surrounds the sprinkler head and is suspended therefrom, so that the casing has a lower edge which lies substantially in the plane of the said lower surface of the ceiling. A cover plate lies against the lower surface of the ceiling and completely covers the aperture, the cover plate having an upwardly-extending abutment that extends snugly into the lower end of the casing. The cover plate is formed of a polymer material that softens at a temperature substantially below the said preselected temperature.

More specifically the cover plate is formed of polyepsilon caprolactone and the casing is formed of a polymer material having a softening temperature substantially above the said preselected temperature.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
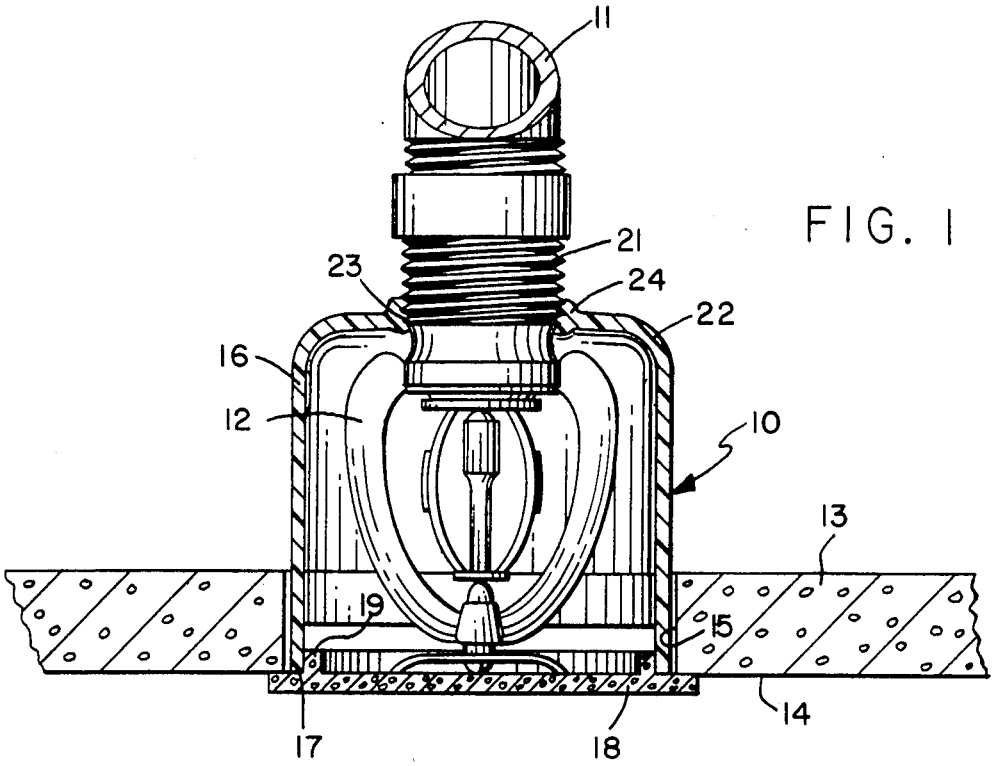
FIG. 1 is a vertical sectional view of a sprinkler assembly embodying the principles of the present invention.

Referring first to FIG. 1, wherein are best shown the general features of the invention, the sprinkler assembly, indicated generally by the reference numeral 10, is shown as consisting of a water distribution pipe 11 which is operatively connected to a sprinkler head 12 which head is operative when exposed to a preselected temeperature, such as 160° F.

A ceiling plaster or tile 13 forms part of a suspended ceiling that underlies the sprinkler. The tile has a lower surface 14, which lies below the lowest point of the sprinkler head and has an aperture 15 to which the lowest point of the sprinkler head lies.

A tubular casing 16, formed of a relatively high-temperature plastic or polymer, surrounds the sprinkler 12 and is suspended from it. The casing is generally tubular or bell-shaped and has a lower edge 17 which lies substantially in the plane of the said lower surface 14 of the tile 13. A cover plate 18 lies against the lower surface of the tile and completely covers the aperture 15 and the lower portion of the sprinkler head. The cover plate has an upwardly-extending cylindrical abutment 19 that fits snugly into the lower end of the casing 16 and is held in place by the friction between the abutment and the inner surface of the casing. The cover plate 18 is formed of a polymer material that softens at a temperature substantially below the said preselected temperature at which the sprinkler 12 operates.

The sprinkler 12 has a threaded neck 21 which extends upwardly for threaded engagement with the water distribution pipe 11 operating in the preferred embodiment through a T-fitting and a coupling.

Figure 2:
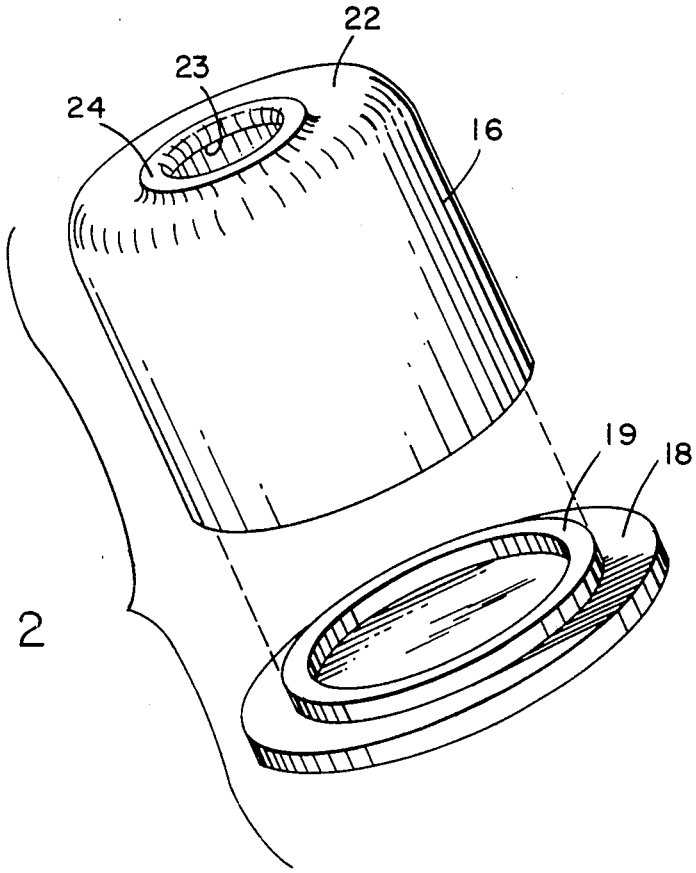
FIG. 2 is an exploded perspective view of a casing and cover plate forming part of the invention.

As is evident in FIG. 2, the casing 16 has an inwardly-directed flange 22 constituting a upper end closure for the tubular casing; the flange 22 defines an aperture 23 which threadedly engages the threaded neck of the sprinkler head. The aperture 23 and the casing is provided with a circular enlarged rim 24 and the entire casing is formed of a semi-rigid plastic, so that the threaded neck 21 can be threadedly joined to the rim 24 by plastic deformation of the latter.

In the preferred embodiment, the aperture 15 in the tile 13 and the cross section of the casing 16 are both circular and of approximately the same size. The interior of the lower end of the casing 16 and the abutment 19 on the cover plate 18 are both cylindrical surfaces of approximately the same size. The cover plate 18 is a circular disk of larger diameter than the aperture 15, so that it extends beyond the edges of the aperture.

In the preferred embodiment, the preselected temperature at which the sprinkler head 12 operates is approximately 160° F., while the softening temperature of the polymer material in the cover plate 18 is approximately 125° F. In the preferred embodiment, the polymer material of which the cover plate is formed is polyepsilon caprolactone. Furthermore, the casing 16 is formed of a plastic or polymer material having a softening temperature substantially above the set preselected temperature at which the sprinkler head 12 operates.

The operation and advantages of the invention will now be readily understood in view of the above discussion. It is assumed that the tile 13 forming part of the ceiling is already in place as is the water distribution pipe 11 with a suitable T or lateral threaded element which is already in place also. The person installing the sprinkler system moves the sprinkler head up through the aperture 15 and threads it into the coupling forming part of the distribution pipe 11, so that the sprinkler head occupies a position in which its lower end lies within the aperture 15 in the ceiling tile. Before installing the sprinkler, however, he threads the threaded neck 22 through the aperture 23 in the casing 16, so that the casing surrounds the sprinkler head and is generally coaxial thereof. Since the rim 24 is formed of semi-rigid plastic, it can be deformed by the threads in the neck 21 to form threads that engage the threads in the neck, so that the casing 16 is held firmly in place. The sprinkler head is installed and adjusted vertically to lie entirely above the surface 14 of the tile 13. It is possible for the installer to rotate the casing 16, allowing the threads to bring its lower edge 17 exactly into the plane of the lower surface 14 of the tile. Finally, after the sprinkler installation has been completed, the installer simply presses the cover plate 18 upwardly, so that the abutment 19 slides snugly into the inner surface of the casing 16 at its lower end. Moving the abutment upwardly vertically eventually will cause the cover plate to engage the lower surface 14 and provide a snug fit and an excellent appearance.

The sprinkler assembly 10, as is shown in FIG. 1, may lie inoperative for a considerable length of time; however, if and when a fire takes place in the room space below the sprinkler head, the temperature of the gases reaching the assembly will increase in proportion to the severity of the fire. When the softening temperature of the cover plate 18 is reached (which in the case of polyepsilon caprolactone will be around 125°), the cover plate will soften and drop out of the casing 16 downwardly in the room. This serves to expose the sprinkler head 12 and to allow it to be subjected to the temperature of the gases rising from the fire. Eventually, the temperatures of the gases will reach the preselected temperature for which the sprinkler has been set, such as 160° F. The low-temperature alloy or other release mechanism in the sprinkler head will cause it to open and spray water downwardly. Because of the formation of the sprinkler, the spray will extend in a broad cone from the bottom of the casing 16 and, presumably, put out the fire. The casing 16 serves as an oven for the hot gases to accumulate before the sprinkler head releases and, after the sprinkler becomes operative, it also prevents water from spraying onto the top of the ceiling 13 and the space above the ceiling, thus reducing the amount of damage. Because the casing 16 is formed of a relatively high-temperature plastic, it will remain in place even in the presence of gases that are hot enough to operate the sprinkler, so that after the sprinkler begins operating the casing is still protective to maintain the water from the spray below the level of the tile 13.

It can be seen, then, that the present apparatus is not only inexpensive but provides an easy, accurate method of adjustment of the casing and the cover relative to the bottom surface of the tile, so that the appearance is excellent. Furthermore, it is clear that the cover plate 18 can be replaced after the fire is put out and the apparatus reactivated. Furthermore, the fact that the installation of the cover plate 18 takes place after all other elements of the sprinkler assembly have been located, means that the cover plate remains clean and does not have to be washed by the installer after the job has been completed.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Sprinkler assembly, comprising:

(a) a water distribution pipe, (b) a sprinkler head having an operating mechanism, the head being operatively connected to the pipe and operative when exposed to a preselected temperature, (c) a ceiling tile underlying the sprinkler head and having a lower surface below the lowest point of the sprinkler head and having an aperture in which the lowest point of the sprinkler head lies, (d) a tubular casing surrounding the sprinkler head and suspended therefrom but independent of the operating mechanism thereof, so that a lower edge of the casing lies substantially in the plane of the said lower surface of the tile, wherein the aperture and the cross-section of the casing are both circular and of approximately the same size, and (e) a cover plate having a flat upper surface lying against the lower surface of the tile and completely covering the said aperture, wherein the cover plate is a relatively thin circular disk of larger diameter than the aperture and has an exposed lower surface that is completely flat, the cover plate having an upwardly-extending integral abutment that extends snugly into the lower end of the casing to hold the cover plate securely in position, wherein the cover plate is formed of a polymer material that softens at a temperature substantially below the said preselected temperature, and wherein the interior of the lower end of the casing and the abutment on the cover plate both have cylindrical surfaces of approximately the same size.

2. Sprinkler assembly as recited in claim 1, wherein the sprinkler head has a threaded neck extending upwardly for threaded engagement with the water distribution pipe, and wherein the casing has an upwardly-directed flange defining an aperture that engages the said threaded neck of the sprinkler head.

3. Sprinkler assembly as recited in claim 2, wherein the aperture in the casing is provided with a circular enlarged rim, and wherein the casing is formed of a semi-rigid plastic, such that the threaded neck can be threadedly joined to the rim by plastic deformation of the latter.

4. Sprinkler assembly as recited in claim 1, wherein the said preselected temperature is approximately 160°

F., while the softening temperature of the polymer material in the cover plate is approximately 125° F.

5. Sprinkler assembly as recited in claim 1, wherein the polymer material is polyepsilon caprolactone, and the casing is formed of a polymer material having a softening temperature substantially above the said preselected temperature.

6. Assembly for use with a sprinkler head having an operating mechanism, the head being operatively connected to a distribution pipe and operative when exposed to a preselected temperature and with a ceiling underlying the sprinkler, the ceiling havig a lower surface below the lowest point of the sprinkler and having an aperture in which the lowest point of the sprinkler head lies, comprising:

(a) a tubular casing surrounding the sprinkler head and suspended therefrom, but independent of the operating mechanism thereof, so that a lower edge of the casing lies substantially in the plane of the said lower surface of the ceiling, and (b) a relatively thin disk-like cover plate having flat upper surface lying against the lower surface of the ceiling and completely covering the said aperture, the cover plate having an exposed lower surface that is completely flat and having an upwardly-extending integral abutment that extends snugly into the lower end of the casing to hold the cover plate securely in position, the cover plate being formed of a polymer material that softens at a temperature substantially below the said preselected temperature, wherein the aperture and the cross-section of the casing are both circular and of approximately the same size, wherein the interior of the lower end of the casing and the abutment on the cover plate both have cylindrical surfaces of approximately the same size, and wherein the cover plate is a circular disk of larger diameter than the aperture.

* * * * *